United States Patent [19]

Sottolana

[11] Patent Number: 4,499,671

[45] Date of Patent: Feb. 19, 1985

[54] SHOE BOTTOM FOR GENERAL FOOTWEAR INCLUDING HEEL, INSTEP, PLANTAR, SUPPORT AND INSOLE

[76] Inventor: Giulio Sottolana, Via Mascheroni 15, Milan, Italy

[21] Appl. No.: 401,172

[22] Filed: Jul. 23, 1982

Related U.S. Application Data

[63] Continuation-in-part of Ser. No. 206,226, Nov. 12, 1980, abandoned.

[30] Foreign Application Priority Data

Nov. 16, 1979 [IT] Italy ..... 27373 A/79

[51] Int. Cl.[3] ..... A43B 13/28; A43B 13/36

[52] U.S. Cl. ..... 36/24.5; 36/30 R; 36/15; 12/142 J

[58] Field of Search ..... 36/24.5, 43, 30 A, 44, 36/30 R, 31 R, 15, 100, 101, 3 R, 25 R; 12/142 J

[56] References Cited

U.S. PATENT DOCUMENTS

| | | | |
|---|---|---|---|
| 1,800,930 | 4/1931 | Crick | 36/3 R |
| 2,095,953 | 10/1937 | Bazzoni | 36/24.5 |
| 2,259,322 | 10/1941 | Parkhurst | 36/24.5 |
| 2,299,305 | 10/1942 | Ciaio | 36/31 |
| 2,379,139 | 6/1945 | Flink | 36/30 R |
| 2,909,854 | 10/1959 | Edelstein . | |
| 2,931,110 | 4/1960 | Pietrocola | 36/30 R |
| 2,953,862 | 9/1960 | Majer | 36/43 X |
| 3,412,487 | 11/1968 | Diamant . | |
| 3,624,930 | 12/1971 | Johnson et al. . | |
| 3,646,692 | 3/1972 | Glogg | 36/24.5 |
| 3,705,463 | 12/1972 | Lown . | |
| 4,320,588 | 3/1982 | Sottolana | 36/24.5 |

FOREIGN PATENT DOCUMENTS

| | | | |
|---|---|---|---|
| 1092165 | 11/1954 | France | 36/15 |
| 1389655 | 1/1965 | France | 36/24.5 |
| 1405943 | 6/1965 | France | 36/24.5 |
| 499735 | 11/1954 | Italy | 36/30 R |
| 357918 | 10/1931 | United Kingdom | 36/31 |
| 1093363 | 11/1967 | United Kingdom | 26/24.5 |
| 2026302 | 2/1980 | United Kingdom | 36/43 |

*Primary Examiner*—James Kee Chi

*Attorney, Agent, or Firm*—Ladas & Parry

[57] ABSTRACT

The shoe bottom unit is made of a single piece of material having an upper side, a lower side, a rear part for supporting a heel, a flexible forepart, and a stiff waist part joining together said forepart and said rear part. The forepart has an opening for receiving a top portion of a wearing member. The wearing member comprises a top portion having an outside contour substantially complementary in shape to the shape of said opening and having a height substantially equal to the thickness of said flexible forepart.

10 Claims, 17 Drawing Figures

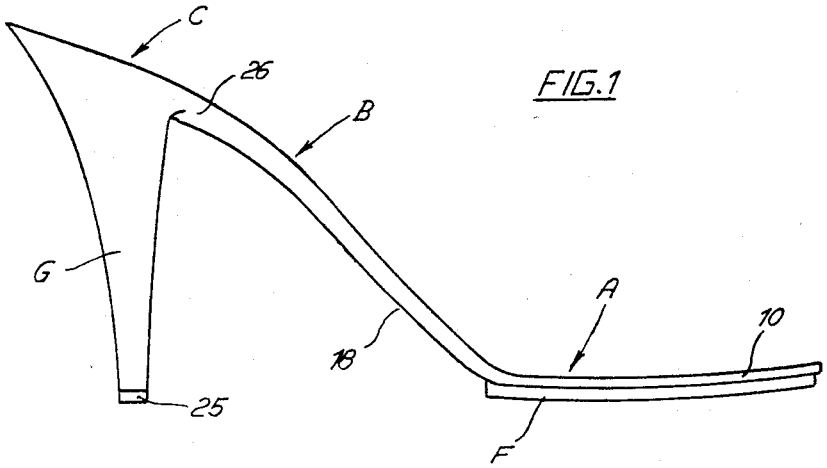
FIG. 1
FIG. 2
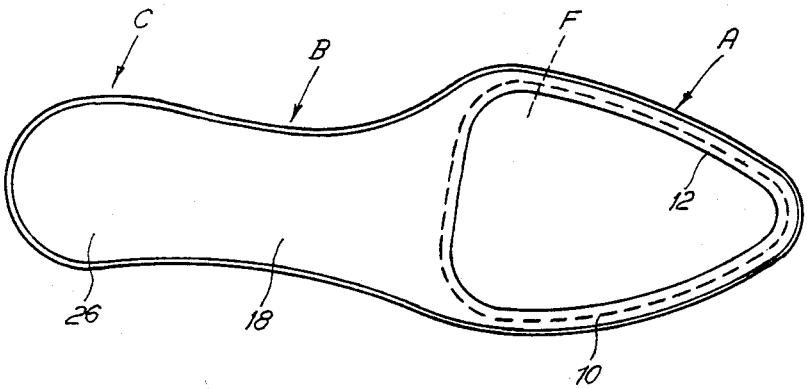
FIG. 3
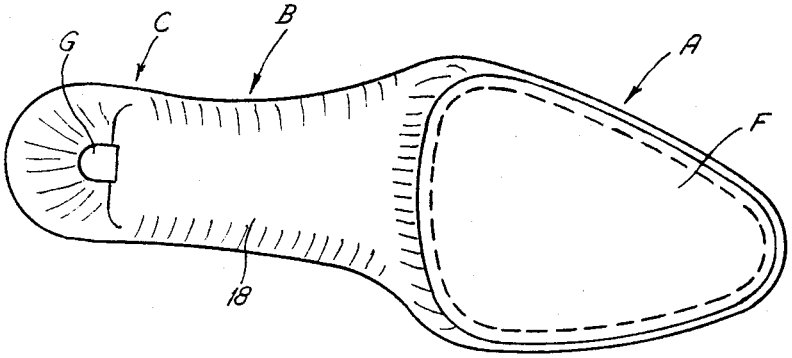

SHOE BOTTOM FOR GENERAL FOOTWEAR INCLUDING HEEL, INSTEP, PLANTAR, SUPPORT AND INSOLE

CROSS REFERENCE TO RELATED APPLICATIONS

This is a continuation-in-part application of the U.S. Application Ser. No. 206,226 filed Nov. 12, 1980 now abandoned.

The present invention relates to a structural bottom for general footwear which includes a rear part or support, an instep or waist part and a fore part, and is made of molded plastics.

BACKGROUND OF THE INVENTION

Limitation in the number of parts is now a requirement in footwear manufacturing to meet shortage of materials. Further, in order to manufacture a footwear bottom, it is necessary to use a large number of parts and hence to perform many fitting-up and assembling steps, which results in waste and other disadvantages.

Attempts have been made to remove these and other disadvantages by utilizing the physical and technological properties of molding resins. However, special manufacturing methods are necessary in processing these components since the use of these materials does not meet the wearer's requirements fully and rationally. In particular, a shoe structure must simultaneously meet the requirements of flexibility, rigidity, wear resistance, transpiration and impermeableness. Accordingly, if one part of a shoe, for example the plantar support, meets some of these requirements, it obviously does not fulfil the other requirements; typical of this is flexibility on the one hand with pressure or load resistance on the other.

SUMMARY OF THE INVENTION

The invention is intended to provide a one-piece bottom for general footwear, i.e. a bottom consisting of one member only, which has all the desired features to meet said requirements, thus removing all factors of insecurity attendant on the joining steps, particularly in case of materials of hetrogeneous characteristics. Also the inventive bottom is suitable to withstand mechanical stress, especially composite stress, such as flexural and compressive stress, which occurs in certain regions of the shoe bottom in walking.

One further object of the invention is to provide a shoe bottom which makes it possible to manufacture, quickly and easily, a given type of desired footwear, either for women or men, in that a limited group of members firmly joined together is made available for the purpose of obtaining the one-piece bottom having the desired characteristics, and then the uppers, wear region and other members will be fitted to said bottom to form the desired footwear quickly.

A further object of this invention is that of avoiding in a shoe, particularly for ladies' wear, the inconvenience due to the enlargement which occurs at the edge of the sole as a result of the presence of the border of the vamp that is fixed between the sole and the inner sole. This generally causes a depression to be formed in the central part of the sole and hence an uneven surface of the sole on which the foot finds support. In the case of the present invention, instead, a surface lacking such unevenness is achieved since the actual sole, which is in contact with the ground, is retained appropriately and in such a manner as to avoid the drawback mentioned hereinabove.

The inventive shoe bottom, preferably formed of molded material, is characterized by an annular fore part, which is so shaped, at least in part, to hold a wear member, or sole proper, on its one side, and the vamp on its other side, said fore part ending in a shaped tag which provides, at least in part, the instep and the plantar support for holding and/or providing the shoe heel.

In practice, this concept may be further developed into many embodiments, all of which come within the protective scope of this patent. Thus, the fore part may be shaped to provide, on one side, a ledge for accomodating part of the wear member or sole and, on the other, a holder for the uppers edge and/or the edge of the arch-support or shoe insole.

With further reference to the structural features of the shoe bottom according to this invention, the annular region is provided in its rear part with a shaped wing which is designed to form the instep in the middle part of the footwear and which may be extended to end in a tailpiece to be fixed to the front of the footwear heel.

The invention will now be explained in detail by the following description, in which reference is made to the accompanying drawings which show illustrative embodiments of the footwear bottom according to the invention.

BRIEF DESCRIPTION OF THE DRAWING

In the drawings:

FIG. 1 is an elevation side view of the inventive bottom intended for women's footwear;

FIG. 2 is a plan view;

FIG. 3 shows a foowear bottom viewed from below;

DESCRIPTION OF THE PREFERRED EMBODIMENT

Figure 4:
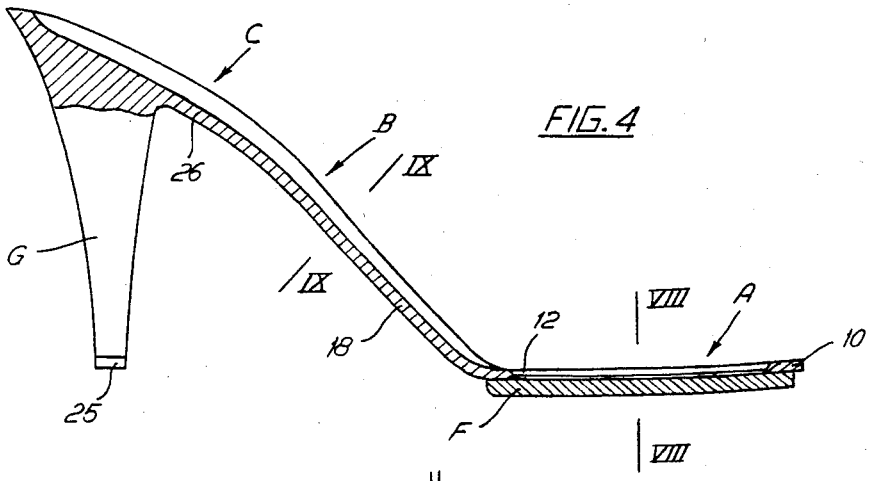
FIG. 4 is a longitudinal section view.

Referring now to the figures in the drawing, the illustrative bottom comprises a fore part A, a waist part B and a rear part C, which are so made and mutually bound as to provide a one-piece member; said bottom may, for example, consist of two members which can be firmly joined to one another, for example by means of adhesives, welding and the like, to provide the one-piece bottom according to the invention.

The fore part A is a substantially triangular shaped ring with arched sides defining a conveniently shaped strip 10. Strip 10 extends inwardly with a wing 12 which is appropriately shaped to hold, on its upper edge, the rim of uppers D, which is tucked up and may thus be fitted thereto in a known manner. Wing 12 is adapted to hold a shaped plate F on its lower edge to provide a wear member or sole.

Figure 8:
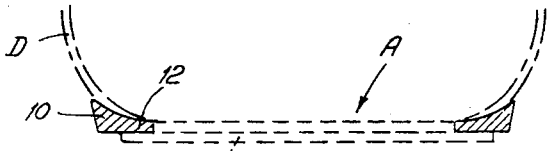
FIGS. 8 and 9 are sections taken along lines VIII—VIII and IX—IX in FIG. 4.
Figure 10:
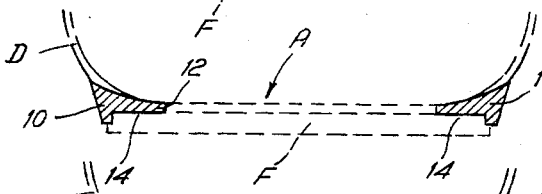
FIGS. 10 and 13 are cross-section views, similar to FIGS. 8 and 9, of embodiments shown in FIGS. 5 to 7.
Figure 11:
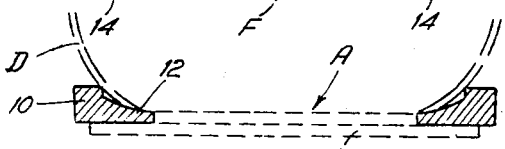
Figure 12:
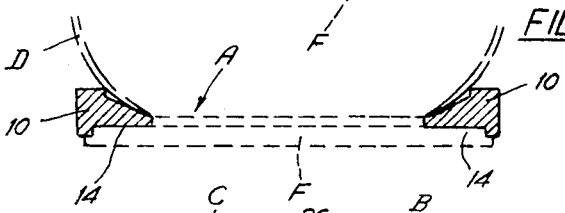

Strip 10 may in practice be shaped to meet various requirements in respect of the intended use of the shoe bottom. Thus, by way of example, as shown in FIGS. 8 and 10, the side edge of said strip may be concealed by uppers D, or, as shown in FIGS. 11 and 12, said side edge may be exposed. Furthermore, the lower side of strip 10 for holding sole F may be flat as shown in FIGS. 8 and 11 or may provide a ledge 14 for accomodating and holding the edge of said sole F (FIGS. 10 and 12). The fore part A of the inventive bottom is so formed as to exhibit appropriate flexibility, in particular when sole F is joined thereto.

Figure 9:
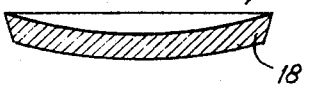

The waist part B consists of a wing 18 (see FIG. 9), which is integral with the rear of strip 10 and is transversely concave on its upper side, its thickness being conveniently greater than the thickness of said strip, whereas its flexibility is lower than that of said strip.

Figure 13:
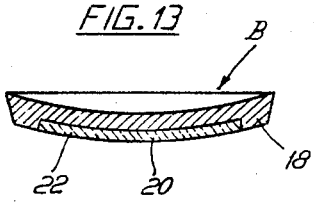
Figure 5:
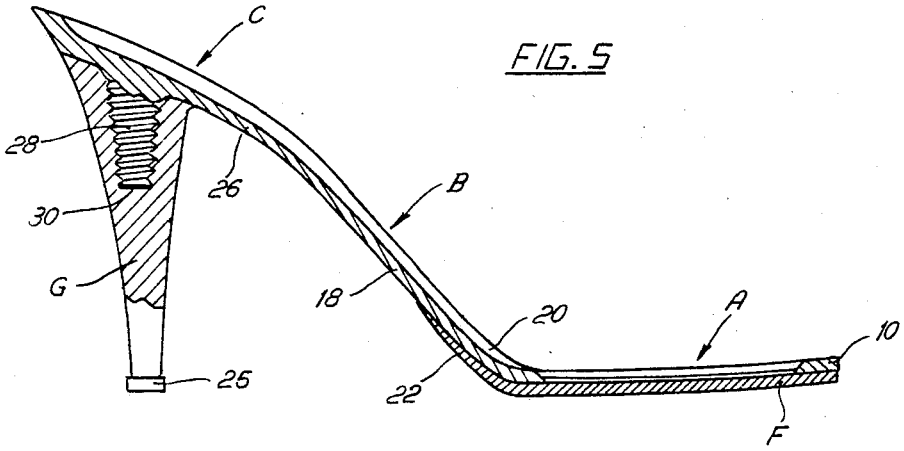
FIGS. 5 to 7 are longitudinal section views of alternative embodiments.
Figure 6:
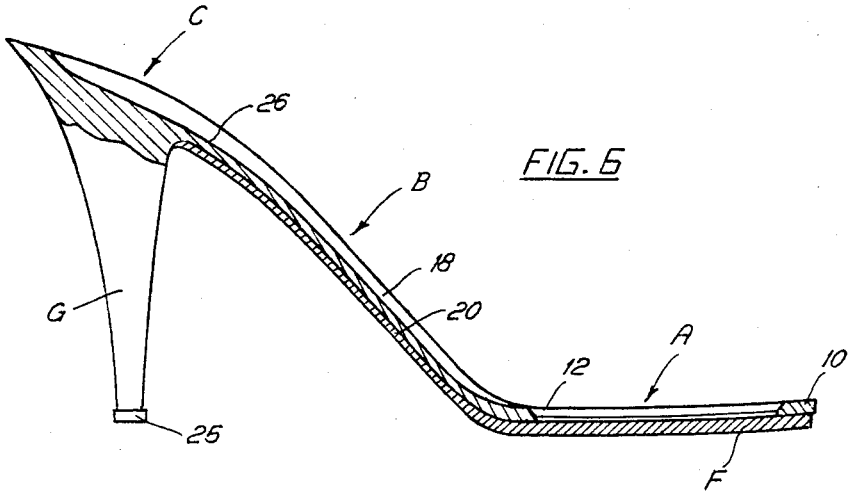
Figure 7:
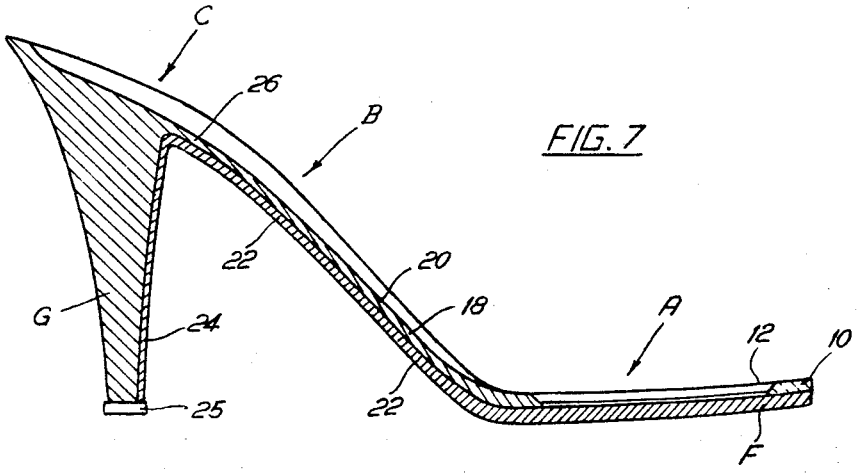

Wing 18 in region B may be provided with a recess 20 (see FIG. 13) on its lower side to accommodate and firmly hold a tongue 22 at the rear end of sole F, as shown in FIG. 6. Said tongue may be provided with a tag 24, which is fitted to the front of the heel itself, which is provided at the rear part C of the shoe bottom (FIG. 7) and is suitable to hold a covering and wear-resistant member 25. The heel may be integral with the rear part of the shoe bottom, as shown in FIG. 4, or it may constitute a separate element which is secured to the rear part C, as shown in FIG. 5. In the case of FIG. 5, the rear part C consists of a shaped plate 26, which is upwardly concave to accommodate the shoe counter and can hold heel G, appropriately shaped as required and firmly joined thereto on its lower side. As shown in FIG. 5, the shaped plate 26 has a post 28 on its lower side, which is conveniently shaped to form a coupling and holding member for heel G, the latter being for this purpose provided with a hole 30, whereinto said post 28 is forced, thereby to provide, along with plate 26, a one-piece member which fulfils the aforementioned requirements of strength.

Further, tongue 22 of sole F in FIG. 5 may, as mentioned above, extend the length of plate 26 and be inserted before heel G thereby reinforcing tongue 22 in the waist part B, said tongue 22 being then permanently coupled to plate 26 by means of adhesives and/or welding and/or other known bonding means, thereby to form a strong structure.

Figure 14:
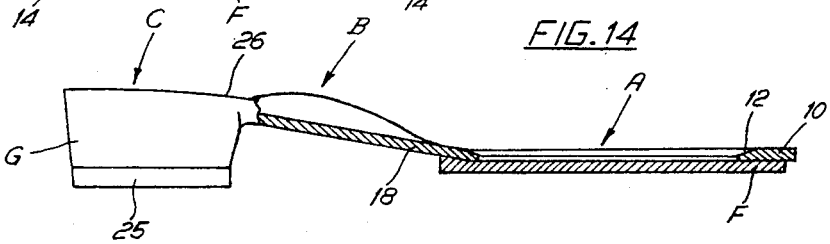
FIGS. 14 and 15 show the inventive bottom for men's footwear in longitudinal and plan views respectively.
Figure 15:
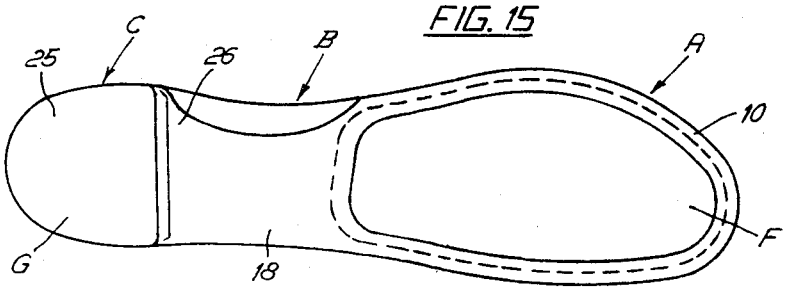

The shoe bottom shown in FIG. 14 and 15 is intended for men's footwear with heel G being an integral part of said bottom structure, conveniently shaped to hold the covering and wear resistant member 25.

The present invention refers to an integral sole made of suitable plastic material to resist strains which mainly occur in the middle of the part B and in the rear of the part C.

Figure 16:
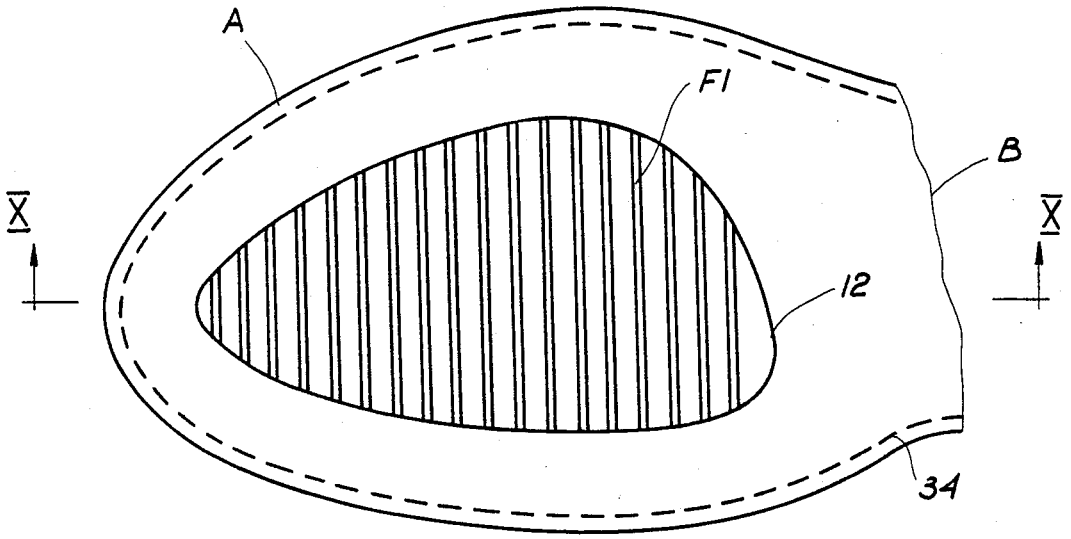
FIG. 16 is a partial plan view.
Figure 17:
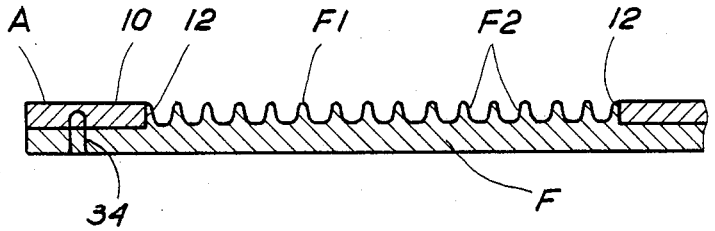
FIG. 17 is a cross-sectional view taken along line X—X in FIG. 16.

The fore part, more precisely the boundary of the parts A and B should have a suitable flexibility which may not be obtained as a result of quality of materials of the parts B and C. To eliminate this substantial drawback the sole according to the present invention is provided with the opening 12 suitably shaped to accept the upper face F1 of the sole part F (see FIGS. 16 and 17).

The frame 10 which is the portion of the interior of the part A is attached to the sole F by means of sewing 34 or also by welding or sticking. The upper face of the sole F1 has the transversal ribs F2 of height substantially equal to the thickness of the frame 10. The part F with the face F1 is made of material which is suitable to produce the necessary flexibility of the composite sole which is a combination of the parts 10 and F. The thickness of the transversal ribs F2 as well as their orientation in respect to the longitudinal axis of the sole may vary in accordance with the desired flexibility of the fore part A.

Thus, according to the present invention, a shoe bottom can be made which meets the requirements which are specific for the particular use intended for the footwear made with said bottom. Also, the manufacturing process is simplified since, in accordance with the invention, the bottom is first fitted to the shoe uppers, which are previously mounted on a respective shoe last, in a known manner. Then sole F is fitted by fastening plate 18 to tongue 22 thereby to provide a structure for the instep having desired flexibility, specially in the case of women's footwear with top heel, as this coupling step is carried out after parts A and B are imparted the desired orientation.

Other embodiments may be considered for the inventive bottom in addition to those considered hereinabove. For instance, the annular structure of the fore part A may be provided with reinforcing strips or bars. The outer edge of strip 10 may be provided with patterns and finishing decorations which are complementary to upper D. These and other embodiments will remain within the scope of the present patent protection.

I claim:

1. A shoe bottom unit comprising:

a shoe bottom made of a single piece of material, said shoe bottom having an upper side, a lower side, a rear part for supporting a heel, a flexible forepart and a stiff waist part joining together said forepart and said rear part said forepart having an opening going therethrough from said upper side to said lower side, said opening adapted to receive a top portion of a wearing member;

said wearing member having a top portion and a bottom portion, said top portion having an outside contour substantially complementary in shape to the shape of said opening and having a height substantially equal to the thickness of said flexible forepart, said top portion of the wearing member having transversal ribs;

said bottom portion of said wearing member having an outside contour substantially complementary in shape to the shape of an outside contour of said forepart;

whereby in an assembled condition of said shoe bottom unit said wearing member is fixedly attached to said flexible forepart in such manner that the entire lower side of said forepart is covered by said wearing member and whereby said wearing member having said transversal ribs on the top portion thereof and said forepart define one flexible unit.

2. A shoe bottom according to claim 1, wherein said one piece of material is one piece of synthetic plastic material.

3. A shoe bottom unit according to claim 1, wherein said transversal ribs on the top portion of the wearing member and said forepart define one unit flexible in latitudinal direction.

4. A shoe bottom unit according to claim 1, wherein the heel is made of as a part of the shoe bottom.

5. A shoe bottom according to claim 1 wherein said wearing member is fixedly attached by cementing.

6. A shoe bottom according to claim 1 wherein said wearing member is fixedly attached by stitching.

7. A shoe bottom unit comprising:

a shoe bottom made of a single piece of material, said shoe bottom having an upper side, a lower side, a rear part for supporting a heel, a flexible forepart and a stiff waist part joining together said forepart and said rear part, said forepart having an opening going therethrough from said upper side to said lower side, said opening adapted to receive a top portion of a wearing member;

said wearing member having a top portion and a bottom portion, said top portion having an outside contour substantially complementary in a shape to a shape of said opening and comprising a flexible material having a height substantially equal to a thickness of said flexible forepart;

said bottom portion of said wearing member having an outside contour substantially complementary in shape to the shape of an outside contour of said forepart;

whereby in an assembled condition of said shoe bottom unit said wearing member is fixedly attached to said flexible forepart in such manner that the entire lower side of said forepart is covered by said wearing member.

8. A shoe bottom according to claim 7 wherein said wearing member is fixedly attached by cementing.

9. A shoe bottom according to claim 7 wherein said wearing member is fixedly attached by stitching.

10. A shoe bottom according to claim 7 wherein the heel is made as a part of the shoe bottom.

* * * * *